US006722816B2

(12) United States Patent
Hoeck, Jr. et al.

(10) Patent No.: US 6,722,816 B2
(45) Date of Patent: Apr. 20, 2004

(54) BERM FORMING APPARATUS

(75) Inventors: John L. Hoeck, Jr., Eugene, OR (US); Paul Wilder, Eugene, OR (US)

(73) Assignee: Rexius Forest By-Products, Inc., Eugene, OR (US)

( * ) Notice: Subject to any disclaimer, the term of this patent is extended or adjusted under 35 U.S.C. 154(b) by 17 days.

(21) Appl. No.: 10/047,393

(22) Filed: Jan. 2, 2002

(65) Prior Publication Data

US 2003/0123933 A1 Jul. 3, 2003

(51) Int. Cl.[7] ..... E01C 21/04; E01C 19/22
(52) U.S. Cl. ..... 404/96; 404/98; 404/108
(58) Field of Search ..... 404/96, 98, 105, 404/106, 108; 405/17; 104/12

(56) References Cited

U.S. PATENT DOCUMENTS

| | | | | | |
|---|---|---|---|---|---|
| 1,522,382 | A | * | 1/1925 | Pain | 404/108 |
| 1,945,065 | A | * | 1/1934 | Mosslang et al. | 401/22 |
| 2,054,437 | A | * | 9/1936 | Mosel | 404/105 |
| 2,094,910 | A | * | 10/1937 | Baily | 404/96 |
| 2,539,063 | A | * | 1/1951 | Ekenstam | 405/265 |
| 2,541,547 | A | | 2/1951 | Robinson | 94/46 |
| 3,328,902 | A | * | 7/1967 | Hanson | 37/350 |
| 3,416,416 | A | * | 12/1968 | Long et al. | 404/96 |
| 3,651,762 | A | * | 3/1972 | Plasser et al. | 104/12 |
| 3,733,141 | A | * | 5/1973 | James, III | 404/98 |
| 3,801,069 | A | * | 4/1974 | McCarstle | 254/326 |
| 3,965,822 | A | * | 6/1976 | Stewart | 104/7.2 |
| 4,253,256 | A | * | 3/1981 | Feliz | 37/104 |
| 4,360,293 | A | * | 11/1982 | Wade | 405/268 |
| 4,489,658 | A | * | 12/1984 | von Beckmann | 104/12 |
| 4,676,690 | A | * | 6/1987 | Allen | 404/110 |
| 4,842,441 | A | * | 6/1989 | Watkins | 404/98 |
| 4,917,533 | A | * | 4/1990 | Wilson | 404/75 |
| 5,158,394 | A | * | 10/1992 | Bresnahan | 404/108 |
| 5,205,218 | A | * | 4/1993 | Theurer | 104/12 |
| 5,249,332 | A | * | 10/1993 | Wilkerson | 15/384 |
| 5,318,444 | A | * | 6/1994 | Kuzub et al. | 414/326 |
| 5,332,331 | A | * | 7/1994 | Critz et al. | 404/96 |
| 6,293,728 | B1 | * | 9/2001 | Eggleton et al. | 404/98 |

FOREIGN PATENT DOCUMENTS

| | | | | |
|---|---|---|---|---|
| GB | 2071046 | * | 1/1981 | B60P/1/00 |

* cited by examiner

*Primary Examiner*—James R. Brittain
*Assistant Examiner*—Katherine Mitchell
(74) *Attorney, Agent, or Firm*—James D. Givnan, Jr.

(57) ABSTRACT

A chassis having a main member carries adjustable side members defining an area for the reception of berm forming particulate material conveyed by an air flow from a remote source. The discharged material forms a continuous berm of constant size and shape. Wheel assemblies are adjustably carried enabling the berm cross-sectional shape to best suit the job requirements. Forward travel to the apparatus may be imparted by a steerable tongue assembly.

11 Claims, 3 Drawing Sheets

BERM FORMING APPARATUS

BACKGROUND OF THE INVENTION

The present invention concerns an apparatus for the formation of a berm serving to confine a flow of contaminants or other matter from a construction site.

Governmental restrictions have been enacted toward preventing the flow of contaminates from a construction or other site which flow can be accomplished by the formation of a temporary berm about the site.

Such berms can be formed from particulate matter, preferably absorbent, to both block passage of matter and absorb at least a portion of the contaminates. Heretofore, such berms have been formed from material shoveled by workers into place to form a loosely constructed berm of non-uniform height and width and incurring considerable man hour effort. A berm so constructed often does not provide a reliable barrier. Further, the material used for such a berm must be stockpiled at the construction site, a problem when space is critical In the prior art, U.S. Pat. No. 2,541,547 discloses a machine adapted for travel along a ground surface and having a hopper to receive asphalt or like material which is subsequently deposited onto a roadway. Trailing members of the machine form raised molded structures on the roadway surface to denote lane separation, parking stalls and provide barriers.

SUMMARY OF THE PRESENT INVENTION

The present invention is directed toward a apparatus which receives particulate material and progressively shapes same in a continuous manner to form berm for blocking and/or absorbing ground contaminating material.

The apparatus receives airborne material from an adjacent source and shapes same, in a continuous manner, into a berm. Provision may be made for altering the cross-sectional shape of the resulting berm, by adjustment of apparatus sides members with beam height varied by positioning the apparatus relative the ground surface. Important objectives of the present invention include the provision of a berm forming apparatus for travel along a predetermined course adjacent a construction site, or other site generating contaminants, to receive and shape material so as to constitute a barrier to the contaminants; the provision of an apparatus of compact construction which includes adjustable components to vary the cross-sectional shape of a berm being formed and further enabling collapsing of the apparatus into a compact state for transport to another work site; the provision of a berm forming apparatus of light weight construction permitting a worker to manually propel same; the provision of a berm forming apparatus having adjustable wheel assemblies permitting raising and lowering of the apparatus to suit berm requirements; the provision of a system for delivering and shaping particulate material from a source, such as a truck, having a blower and flexible delivery conduit serving the apparatus.

DETAILED DESCRIPTION OF THE PREFERRED EMBODIMENTS

Figure 1:
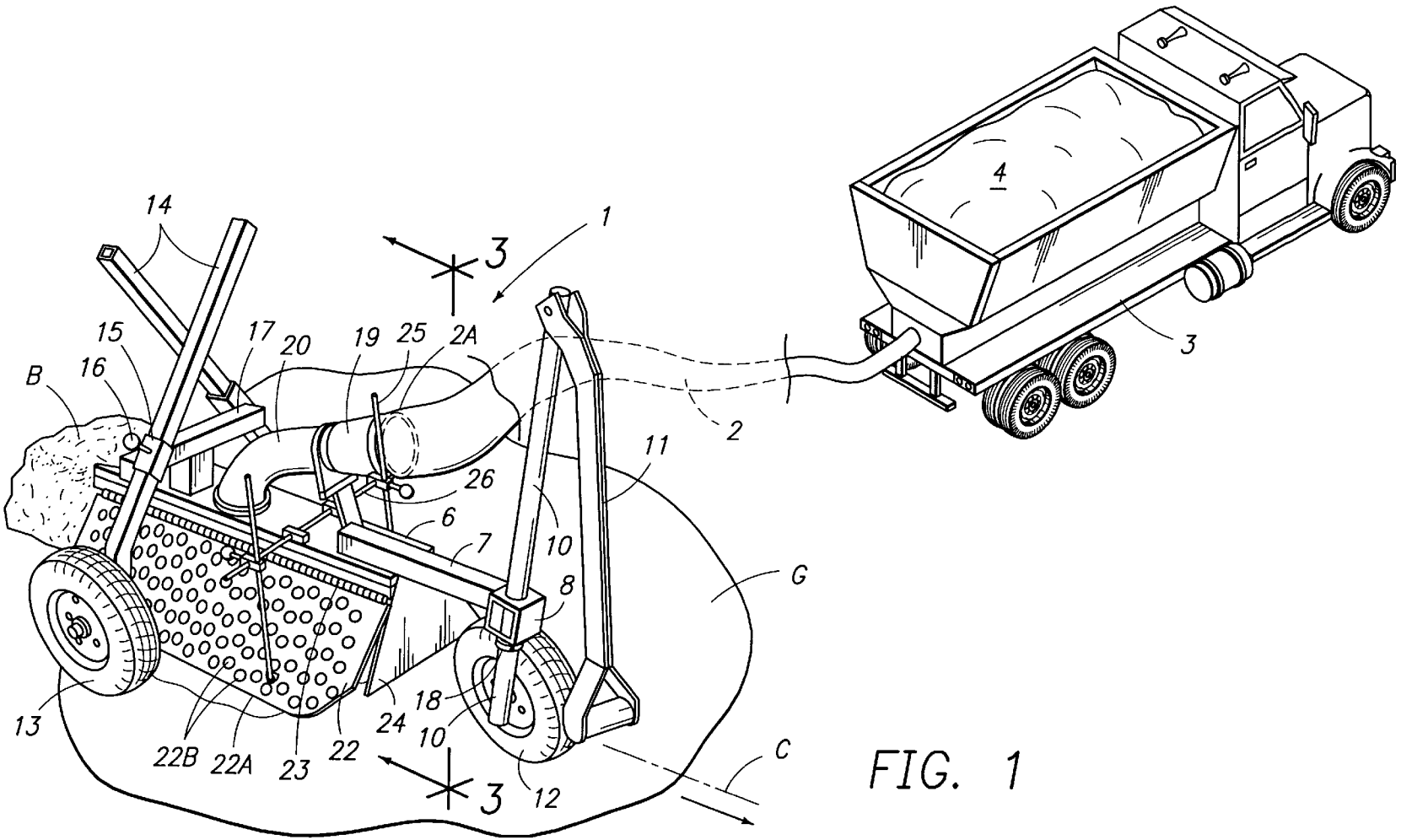
FIG. 1 is a perspective view of the present apparatus shown in communication via a conduit with a bulk delivery truck.

With continuing attention to the drawings wherein applied reference numerals indicate parts similarly hereinafter identified, the reference numeral 1 indicates generally the present berm forming apparatus in receiving communication via a conduit 2 with a truck at 3 of the type including a blower for propelling particulate material 4 through conduit 2.

Berm forming apparatus 1 is of a size and weight to permit a worker to pull same along a course C on a ground surface at G. The course would normally define an area within which a contaminant or contaminants must be confined in accordance with governmental requirements.

The machine includes a chassis with a main member 6 having a forward end supporting a tow arm 7 which in turn supports a block 8 receiving a steering post 10. A tongue is at 11 for steering of a front wheel 12. A post mounted collar 18 is positionable along post 10. Wheels at 13 support the rearward end of chassis 6 by means of struts 14 both of which are adjustable in an inclined manner in sleeves 15 having set screws as at 16. The sleeves 15 are secured in place on chassis 6 by a cross arm 17. The length of chassis 6 is such as to permit the machine to be highly maneuverable as well as easily drawn along a ground surface by a workman.

An elbow shaped airflow inlet at 20 on the main member 6 is in upstream communication via an adapter 19 with conduit 2 for the reception of particulate material into an area 9 below chassis 6.

Figure 4:
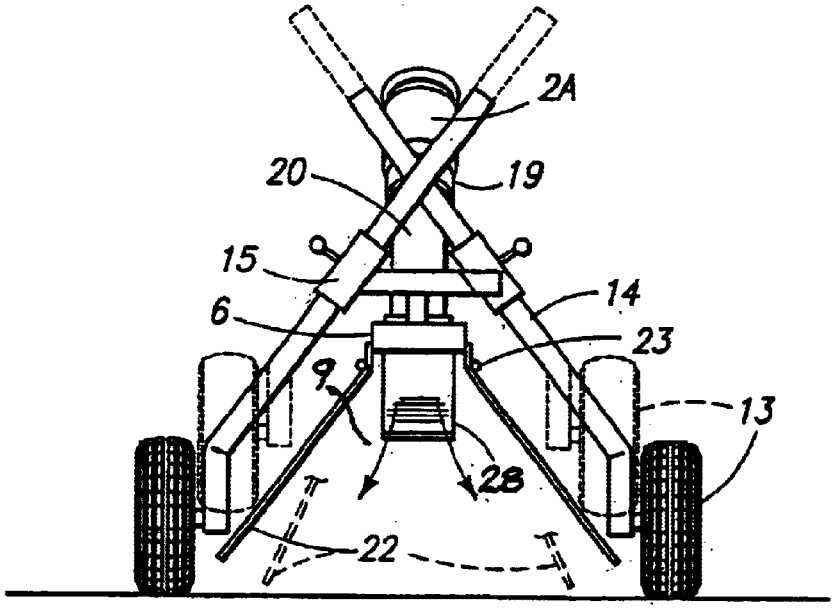
FIG. 4 is a rear elevational view of FIG. 3 with the apparatus configured for transport.

Plates at 22 constitute side members supported by hinges at 23 on chassis 6 with the plates oppositely offset and serving to confine particulate material discharged from elbow 20. Plate lower edge at 22A is proximate ground surface G during use of the apparatus. A third plate at 24 serves as a barrier and closes the forward end of the area at 9 below main member 6. As best seen in FIG. 4, a deflector at 28 is carried by chassis 6 immediately forward of the outlet end of elbow 20 to impart a rearward component to the downward flow of material exiting elbow 20. Apertures at 22B in plate 22 vent area 9 receiving the particulate material.

Figure 2:
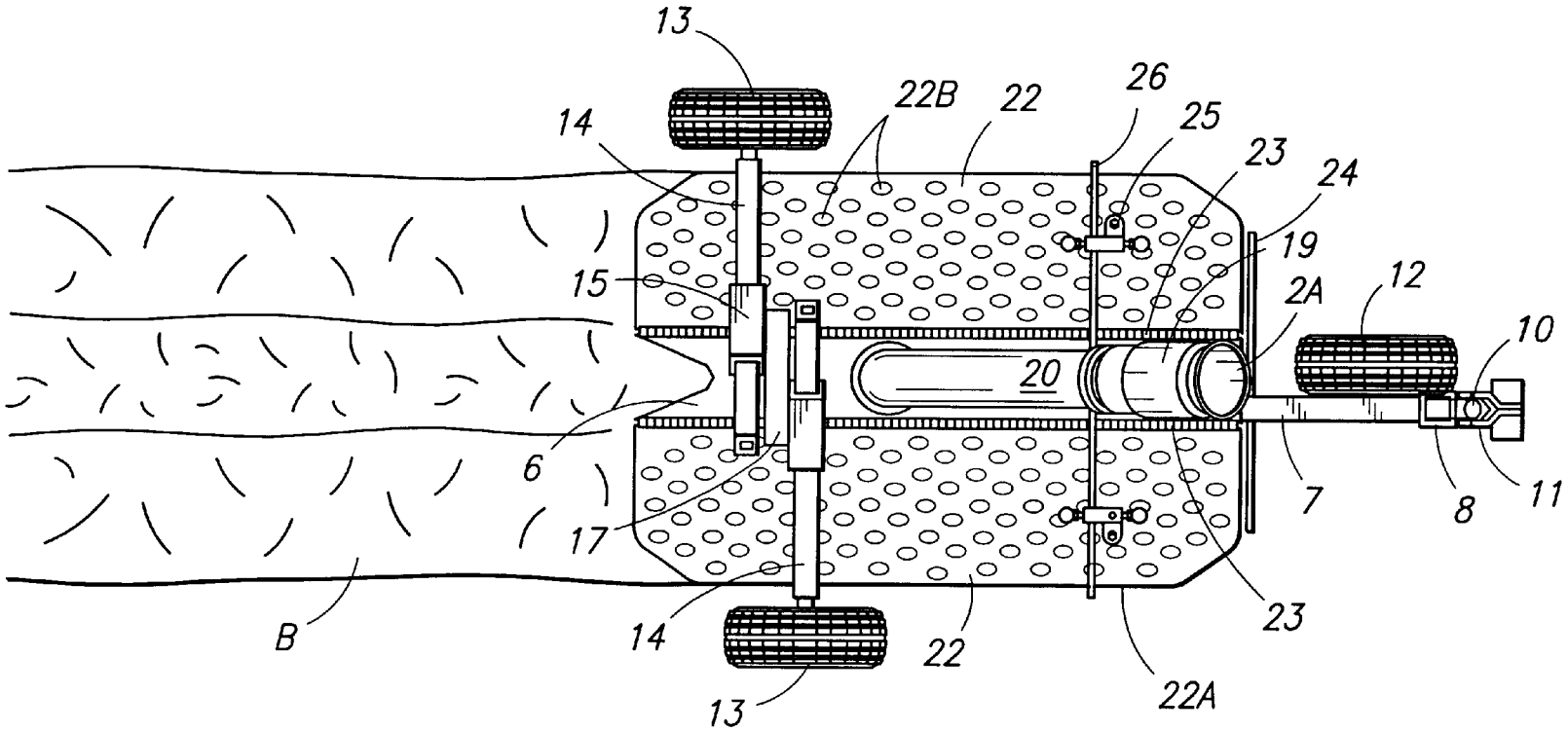
FIG. 2 is a plan view of the apparatus.
Figure 3:
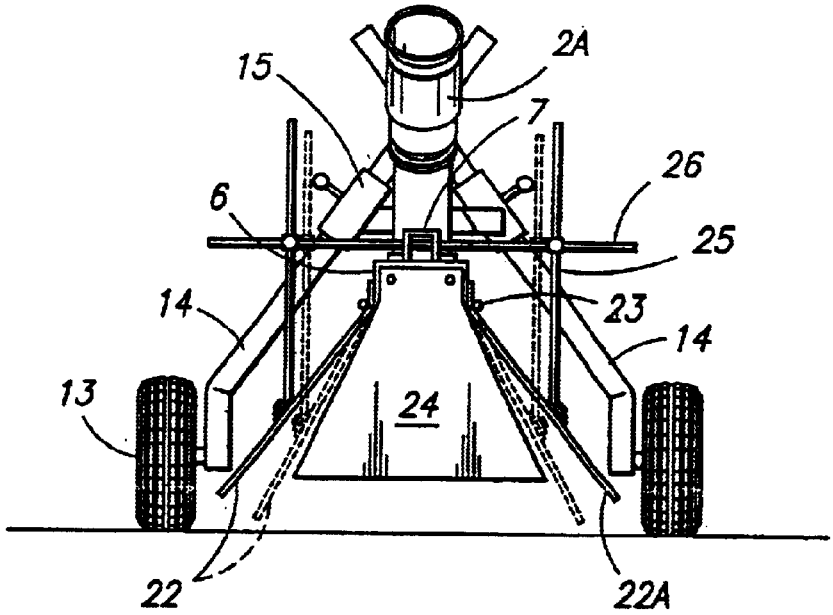
FIG. 3 is a vertical sectional view of the apparatus taken along line 3—3 of FIG. 1.

To enable varying of the berm cross section plates 22 are positionable about hinges 23 and are retained in place by adjustable supports 25 FIG. 2) carried by a rod member 26 in place crosswise on chassis 6. As noted earlier, berm height may be varied by linear adjustment of struts 14 in sleeves 15 to raise or lower chassis main member 6.

In the operation of the machine, the adjustable components, i.e., plates 22 and wheels 13, are adjusted by the operator to provide a berm of adequate cross section to perform the barrier task at hand. Bulk delivery truck 3 is located adjacent the course C and upon operation of the truck mounted blower a continuous flow of particulate is provided to the present apparatus and discharged into area 9 below main member 6 defined by the pair of side members 22 and frontal barrier 24. Travel of the apparatus along course C will provide a barrier or berm B of absorbent material having a truncated pyramidal shape.

One form of particulate that has proved highly satisfactory both costwise and effectiveness is organic material such as bark and other wood by-products mixed with organic compost. Such particulate, at the termination of usefulness, may be readily collected for transfer to a disposal site. The type of particulate material utilized may be varied, of course, to best suit the specific contaminant to be confined. To increase adhesion of the berm particles, water or water and an organic tackifier may be injected into the flow of material in conduit 2. A suitable product for berm formation is the subject of U.S. Pat. No. 6,585,452 B1.

Upon termination of berm construction the present machine may be collapsed by relocating of the pair of side members or plates 22 inwardly and the upward retraction of struts 14 to locate wheels 13 proximate the side members and elbow 20 disconnected from conduit end 2A permitting the apparatus to be transported on vehicle 3 enabling convenient delivery of both the apparatus and berm material by the same vehicle to a new work site.

While I have shown but one embodiment of the invention, it will be apparent to those skilled in the art that the invention may be embodied still otherwise without departing from the spirit and scope of the claimed invention.

Having thus described the invention, what is desired to be secured by a Letters Patent is:

We claim:

1. A particulate-material-berm forming apparatus, said particulate material to serve as a barrier in place on a ground surface, said apparatus comprising a chassis including an elongate main body having a lengthwise axis, oppositely disposed perforate side members on said main body each of said side members oppositely disposed from the axis of the main body, an airflow inlet on said main body for receiving a flow of airborne particulate and in communication with an area subjacent the main body and between the side members, means for imparting horizontal travel to said chassis along a course, and means for supporting said chassis proximate the ground surface.

2. The apparatus claimed in claim 1 wherein said side members are adjustably supported by said main body.

3. The apparatus claimed in claim 1 additionally including hinge means connecting said side members to said main body.

4. The apparatus claimed in claim 1 additionally including a deflector on said main body acting on the airborne particulate material, a barrier acting on the particulate material and carried at one end of said main body.

5. The apparatus claimed in claim 1 wherein said means for supporting said chassis includes wheels and struts coupling said wheels to said main body.

6. The apparatus claimed in claim 5 additionally includes sleeves each slidably housing one of said struts enabling raising and lowering of the main body and side members to determine berm height.

7. An apparatus for the formation of a berm of particulate material on a ground surface and comprising, a main member, side members and a frontal barrier depending from said main member, said main member and side members and said frontal barrier defining an area for the reception and momentary confinement of particulate material to form a segment of the berm, an airflow inlet on said main member for receiving and discharging particulate material into the area, and means attached to the main member for moving the machine along a predetermined course to provide a continuous berm.

8. The apparatus claimed in claim 7 additionally including support means on said main member for maintaining the side members at selected positions relative said main member.

9. The apparatus claimed in claim 8 additionally including hinges coupling said main member to said side members.

10. The apparatus claimed in claim 7 additionally including wheels and downwardly diverging wheel supporting struts, sleeves on said main body each receiving one of said struts in an axially adjustable manner.

11. The apparatus claimed in claim 7 wherein said side members are of perforate construction.

* * * * *